US009194606B2

(12) United States Patent
Braathen

(10) Patent No.: US 9,194,606 B2
(45) Date of Patent: Nov. 24, 2015

(54) WATER-HEATER, A COMBINATION OF A TOP COVER AND BOTTOM TRAY FOR A WATER HEATER, AND A BOTTOM COVER

(76) Inventor: Thor Frølich Braathen, Eggedal (NO)

( * ) Notice: Subject to any disclaimer, the term of this patent is extended or adjusted under 35 U.S.C. 154(b) by 639 days.

(21) Appl. No.: 13/322,742

(22) PCT Filed: May 12, 2010

(86) PCT No.: PCT/NO2010/000176

§ 371 (c)(1),
(2), (4) Date: Jan. 4, 2012

(87) PCT Pub. No.: WO2010/137987

PCT Pub. Date: Dec. 2, 2010

(65) Prior Publication Data

US 2012/0067301 A1 Mar. 22, 2012

(30) Foreign Application Priority Data

May 29, 2009 (NO) ..... 20092120

(51) Int. Cl.

| | |
|---|---|
| ***F24H 9/02*** | (2006.01) |
| ***F24H 9/16*** | (2006.01) |
| ***F24H 9/20*** | (2006.01) |
| *F24H 1/18* | (2006.01) |

(52) U.S. Cl.
CPC .. *F24H 9/16* (2013.01); *F24H 9/02* (2013.01); *F24H 9/165* (2013.01); *F24H 9/2021* (2013.01); *F24H 1/18* (2013.01)

(58) Field of Classification Search
CPC ... E03B 11/00; E03B 2001/045; F24H 9/165; F24H 9/0015; F24H 9/0021; F24H 9/12; F24H 9/16; F24D 19/08
USPC ..... 122/13.3, 19.1, 19.2, 13.01, 14.1, 14.3, 122/15.1, 18.31
See application file for complete search history.

(56) References Cited

U.S. PATENT DOCUMENTS

| | | | | |
|---|---|---|---|---|
| 2,328,245 | A * | 8/1943 | Yavitch | 122/13.01 |
| 4,805,662 | A * | 2/1989 | Moody | 137/312 |
| 4,944,253 | A * | 7/1990 | Bellofatto | 122/14.21 |
| 5,134,683 | A * | 7/1992 | Powell | 392/449 |
| 5,881,762 | A * | 3/1999 | Janesky | 137/312 |
| 6,058,892 | A * | 5/2000 | Haack, II | 122/13.01 |
| 6,701,069 | B1 * | 3/2004 | Cezayirli et al. | 392/490 |
| 7,458,340 | B2 * | 12/2008 | Takeda et al. | 122/31.1 |
| 7,900,589 | B2 * | 3/2011 | Gordon et al. | 122/18.31 |
| 7,971,560 | B2 * | 7/2011 | Gordon et al. | 122/15.1 |
| 2006/0169321 | A1 * | 8/2006 | Houle | 137/312 |
| 2008/0017135 | A1 * | 1/2008 | Broadway et al. | 122/19.2 |

OTHER PUBLICATIONS

"Norwegian Application Serial No. 20092120, Search Report dated Dec. 22, 2009", 2 pgs.

* cited by examiner

*Primary Examiner* — Gregory A Wilson
(74) *Attorney, Agent, or Firm* — Schwegman Lundberg & Woessner, P.A.

(57) ABSTRACT

The invention relates to a water heater comprising a water tank, and a number of passageways for connection of valves and water tubes, in which an integrated channel or void is at least extending below the water tank and leads into an outlet to a drain. In one aspect, the invention also relates to a combination for a water heater comprising a top cover and a bottom tray, and in another aspect to a bottom cover for a wall mounted water heater.

10 Claims, 4 Drawing Sheets

Figure 3:
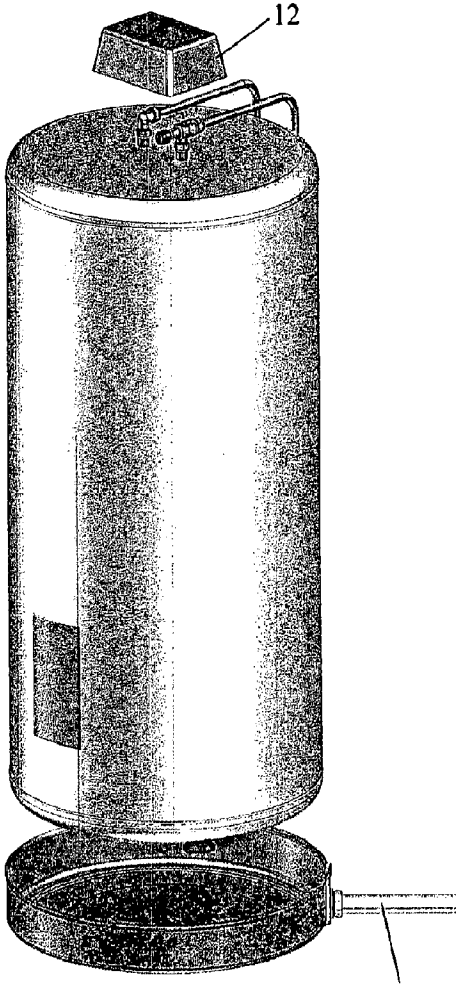

WATER-HEATER, A COMBINATION OF A TOP COVER AND BOTTOM TRAY FOR A WATER HEATER, AND A BOTTOM COVER

RELATED APPLICATIONS

This application is a nationalization under 35 U.S.C. 371 of PCT/NO2010/000176, filed May 12, 2010 and published as WO 2010/137987 A2 on Dec. 2, 2010, which claimed priority to Norwegian Patent Application No. 20092120, filed May 29, 2009; which applications and publication are incorporated herein by reference in their entirety.

TECHNICAL FIELD

The present invention relates to a water heater, a combination of a top cover and a bottom tray for a water heater, and a bottom cover for a water heater, and more specifically to a water heater, a combination, and a bottom cover.

BACKGROUND OF THE INVENTION

There are presently known water heaters or boilers for mounting on a floor and having valves arranged at the top or at the bottom. Similarly, there exist water heaters for mounting on a wall and connected at the bottom.

The present design is based on permanently tight tubing to the valves and the tank of the water heater. However, in practice, one or several components will sooner or later start leaking, in the range from some drops per hour and to a complete blowout.

If it was decreed by law that all water heaters should be arranged in rooms with a floor drain water leakage would not have occurred, at least not in the present extent, but such a law does not exist and the installer can thus make his completely own decisions and take the risks that no water damages will later occur.

A recently implemented requirement from water heater manufacturers states that if the water heater is not arranged in a room provided with a floor drain, a water stop valve (with a function similar to what is used in some dishwashing machines) has to be mounted. This water stop valve thus functions by means of a sensor line which contacts the floor, and if water on the floor should be sensed, the valve will close the cold water inlet to the water heater. The water heater will thus not be replenished with cold water when a water leakage is occurring, but the water volume already contained in the water heater will not be influenced by the water stop valve. For a water heater with a capacity of 200 liters, as much as 200 liters will then be able leak out and cause large and expensive water damages in the building. In countries in which the agglomeration of buildings is dominated by wooden structures, such as in Norway and in the remaining Nordic countries, the costs will inherently be particularly large due to such leakages, and at the same time the risk of such damages is larger in a relative perspective due to the risk of frost.

In this context it should be mentioned that the total costs in Norway per year related to water damages amount to in the order of 3 billon Norwegian kroner.

As to prior art, US 20080017135 A1 and US 20060169321 A1 disclose two respective leakage protection bags to be drawn around a water heater and having an outlet at the bottom, and U.S. Pat. No. 5,881,762 A discloses a bottom tray with an outlet to be retrofitted below a water containing device, such as a water heater.

BRIEF SUMMARY OF THE INVENTION

The object of the water heater, the combination and the bottom cover according to the present invention is to mitigate or eliminate the above-mentioned and other disadvantages.

Advantageous embodiments of the invention are stated in the dependent claims.

BRIEF DESCRIPTION OF THE SEVERAL VIEW OF THE DRAWINGS

Figure 2:
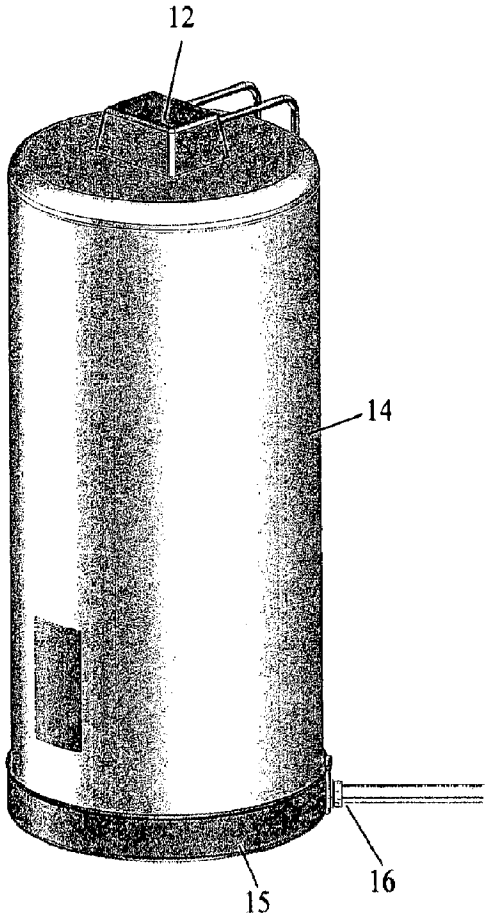
Figure 1:
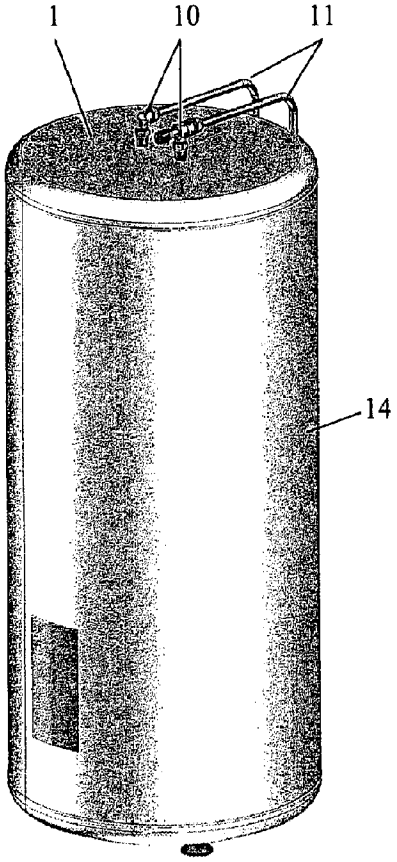
Figure 6:
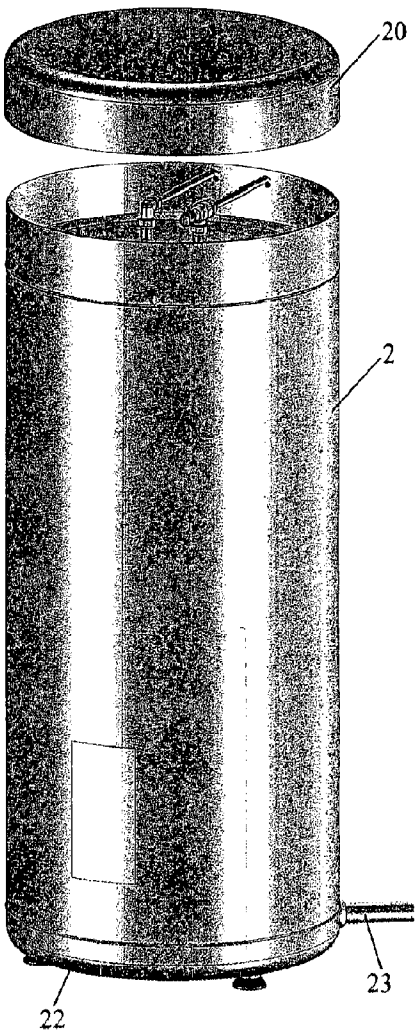
Figure 5:
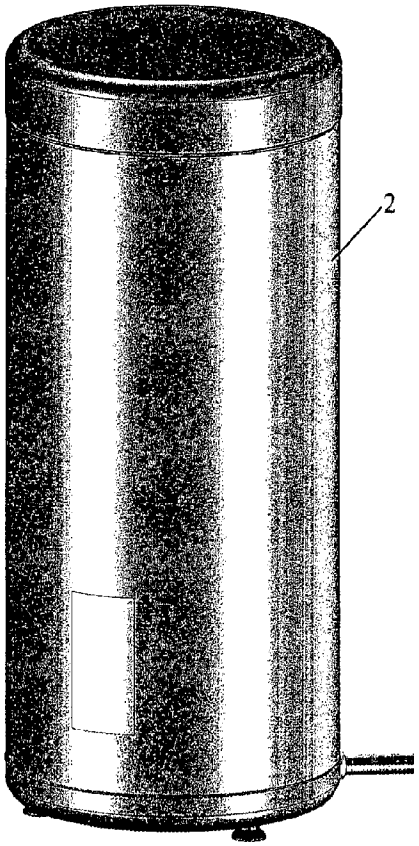
Figure 4:
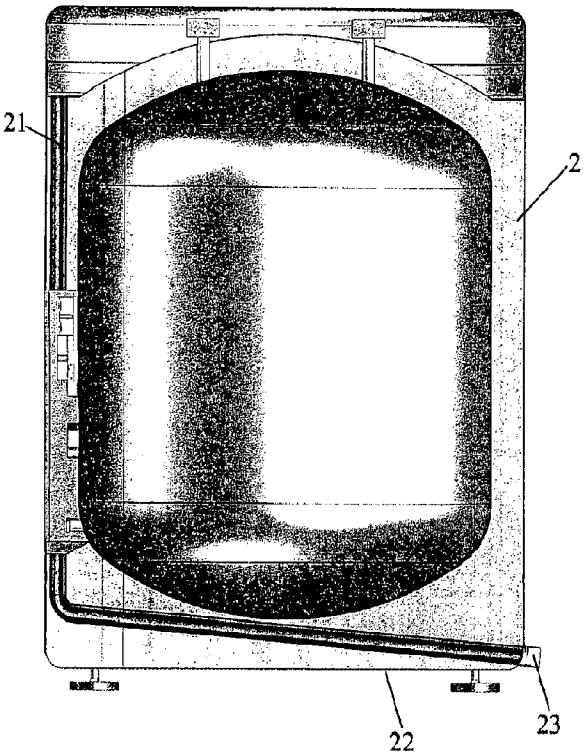
Figure 8:
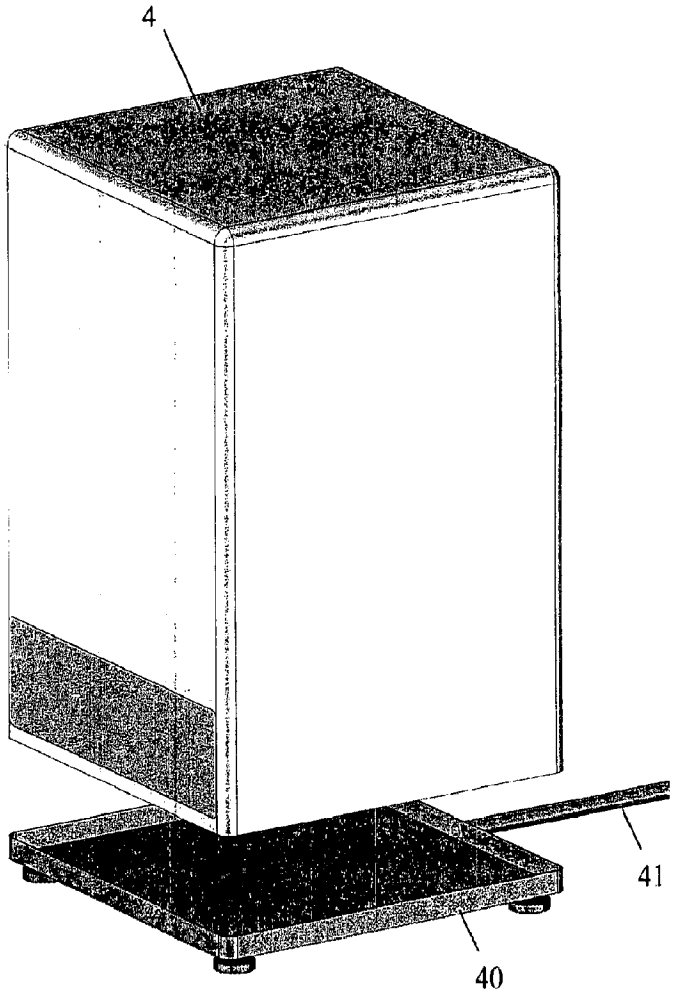
Figure 7:
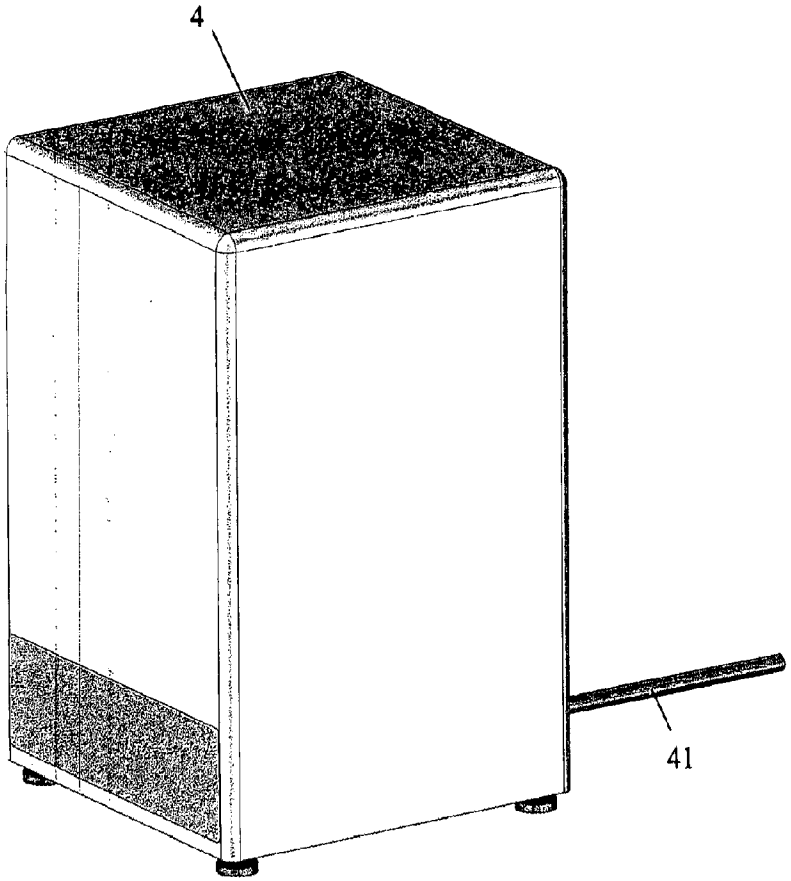
Figure 9:
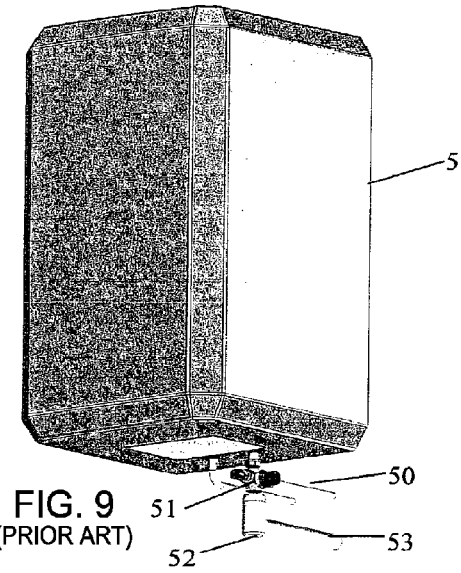
FIG. 9 (PRIOR ART)
Figure 10:
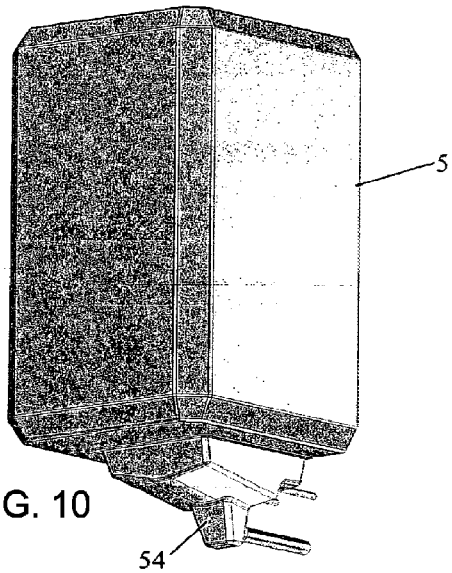
Figure 11:
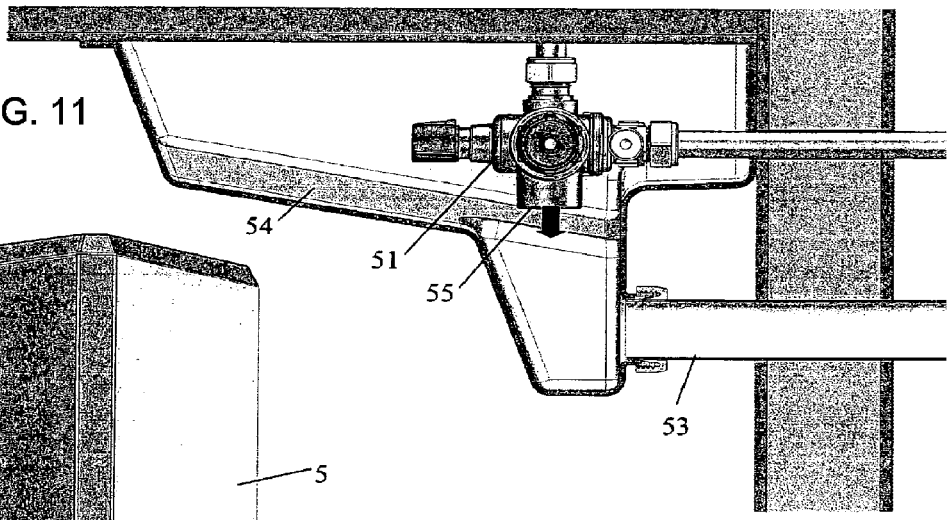
Figure 12:
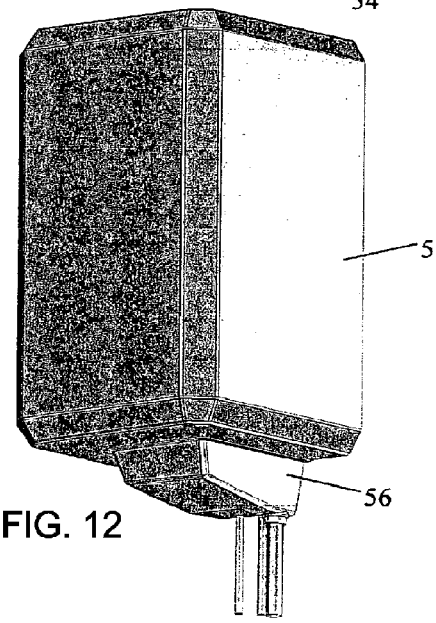

In the following, embodiments of the invention are described, with reference to the enclosed drawings, in which:

FIG. 1 is a perspective view of a water heater according to the prior art and with top mounted valves, FIG. 2 is the water heater according to FIG. 1 with a combination of a top cover and a bottom tray according to a first aspect of the present invention, FIG. 3 is an exploded view of the water heater and combination shown in FIG. 2, FIG. 4 is a partial sectional view of a water heater according to a second aspect of the present invention, with top mounted valves, FIG. 5 is a perspective view of the water heater in FIG. 4, however somewhat extended, FIG. 6 is a perspective view of the water heater in FIG. 5, with the top cover separately shown, FIG. 7 is a perspective view of a simplified embodiment of a water heater according to the second aspect of the invention, FIG. 8 is an exploded view of the water heater shown in FIG. 7, FIG. 9 is a perspective view of a wall mounted water heater according to the prior art, with bottom mounted combination valve, and with water tubes and overflow to drain lead into the wall, FIG. 10 is a perspective view of the water heater in FIG. 9, and with a bottom cover according to a first embodiment of a third aspect of the present invention adapted to water tubes and overflow to drain lead into the wall, FIG. 11 is a section view of the embodiment of the bottom cover shown in FIG. 10, and in which also the bottom mounted combination valve is shown, and FIG. 12 is a perspective view of the water heater in FIG. 9, and with a bottom cover according to a second embodiment of the third aspect of the invention adapted to water tubes and overflow to drain lead along the wall.

FIG. 1 shows a prior art water heater with top mounted valves 10 and water tubes 11. The not shown tank of the water heater is surrounded by an insulation shell 14, as it appears from the figure.

BRIEF DESCRIPTION THE INVENTION

According to a first aspect of the present invention, and as shown in FIGS. 2 and 3, a top cover 12 is covering the valves 10 such that possible spray leakage from the valves 10, or an area around these, are prevented and transformed into a running flow of water down along the insulation shell 14 and which are caught by a bottom tray 15 arranged below the water heater 1, and with side walls advantageously extending upwards along a lower part of the water heater such that the water can run down between an inner side of the sidewalls of the bottom tray 15 and an outer surface of the water heater 1, down into the bottom tray 15, and further to drain via an outlet 16. The invention according to this first aspect of the invention is thus constituted by a combination of the top cover 12 and the bottom tray 15, and is very suitable for being retrofitted to existing, conventional water heaters 1 in order to prevent expensive and destroying leakages from these. In addition to catching water from the valves 10 or the top mounted tubing, such as the water tubes 11, the bottom tray 15 will also catch water leakages from other places on or within the water heater, such as the tank of the water heater 1, internal connections or through passages such as for electric heating element, drain or emptying plug, etc.

According to a second aspect of the present invention, and as shown in FIGS. 4-6, a channel or inner void 21 is extending from the top of a water heater 2, covered by a lid 20, downwardly along a side of the water heater 2, preferably a front side of the water heater 2 which comprises a sealed, closable room for electronics, switches, drain plug and/or through passage for heating element, and which channel or void 21 is further extending to below the water tank of the water heater 2 and to a connection 23 for outlet to drain, which is preferably oppositely arranged on a rear part of the water heater 2. Top mounted valves and tube connections are arranged within the lid 20, as also shown in said figures.

The insulation shell 14 is advantageously made of a suitable foam material which enables, in an efficient and cost effective way, to form the void or channel 21 when the insulation shell 14 is manufactured.

Except from the fact that the invention according to the above-mentioned second aspect efficiently prevents water leakage from any location on or within the water heater 2, an attractive and integrated design is achieved.

A simplified embodiment of the second aspect of the invention is shown in FIGS. 7 and 8, in which the channel or void is substantially only extending below the lower part of a water heater 4, as a bottom tray 40 coupled to drain via an outlet 41 constitutes an integrated and sealing part of the water heater 4 and in which possible leakage from the not shown water heater tank or heat pumps, expansion vessel, valves or connections arranged in the channel or void will be safely lead to drain via the outlet 41 without any damage on the building structure or on the household effects or furniture.

FIG. 9 shows a prior art wall mounted water heater 5 with bottom mounted water tubes 50, and with bottom mounted combination valve 51 with overflow to drain via a funnel 52. As shown, the water tubes 50 and the outlet tube 53 is lead into the wall. Any possible leakage from the water heater 5, from the valve 51 or from remaining connections will be leaking right into the room and possibly causing a large leakage damage both on the building and on household effects and furniture. In this regard, it should be added that wall mounted water heaters are often located in kitchens and other rooms without any floor drain. In addition, the installation itself is not particularly nice, even with nickel plated water tubes 50 and nickel plated valve 51, and with this unsecured solution children will be able to adjust or tamper with the valve 51 or to burn themselves on hot components.

According to a first embodiment of a third aspect of the invention, and as shown in FIGS. 10 and 11, a lower part of the water heater 5 shown in FIG. 9 is surrounded by a bottom cover 54 which at its top seals or bears against a lower surface of the water heater 5, and which is further provided with sealed passages for water tubes 50 and for outlet tubes 53, respectively, as the outlet tube is coupled to a lower part of the bottom cover 54 in order to lead away possible leakage from any location within the bottom cover 54, and not only from the overflow of the safety valve 55 as in the prior art solution of FIG. 9.

FIG. 12 shows a second embodiment of the third aspect of the invention, which is distinguished from the embodiment shown in FIGS. 10 and 11 by a bottom cover 56 adapted to water tubes 50 and outlet tubes 53 lead along the wall instead of into the wall.

The covers 54, 56 according to the third aspect of the invention is very suitable for being retrofitted to existing water heaters 5, in addition to the option of being delivered as a part of new water heaters.

All directional terms in the description and in the claims of the kind "front", "in front of", "foremost", "rear", "rearmost", "upper", "lower", "top", "bottom", etc. are related to a water heater in its mounted operational state.

The invention claimed is:

1. A water heater comprising:

a water tank, and a number of passageways for connection of valves and water tubes, wherein an integrated channel is extending within an outer shell of the water heater from a compartment below a top cover of the water heater down along a side of the water heater and below the water tank, and said channel leading into an outlet to a drain.

2. The water heater according to claim 1, wherein a bottom tray constitutes an integrated and sealing part of the water heater.

3. The water heater according to claim 1, wherein a sealed, closable room for electronics, switches, drain plug, through passage for heating element, and/or similar is arranged at a side of the water heater, and in that that part of the channel or void which extends downwardly along a side of the water heater is crossing the closable room and is in fluid connection with the closable room.

4. The water heater according to claim 3, wherein the closable room which is fluid connected with the channel or void is arranged at a front side of the water heater and that the outlet is arranged at a lower, opposite side of the water heater.

5. The water heater according to claim 1, wherein at the top of the water heater, the channel or void is delimited by a lid, and that top mounted valves and tube connections can be accommodated in the channel or void within the lid.

6. A combination for a water heater with top mounted valves and tube connections for water tubes, comprising:

a top cover and a bottom tray, said top cover being formed in order to cover the valves and the tube connections, such that spray leakage is prevented and that a channel is formed within an outer shell of the water heater, from a compartment within said top cover to a compartment within said bottom tray, so that leaking water will flow down through said channel along the water heater, and that the bottom tray is arranged to be placed below the water heater and formed in order to catch the flowing water and lead it to a drain via an outlet, wherein side walls of the bottom tray are extending upwardly along a lower part of the water heater, and with a gap between the sidewalls and the water heater for flowing water.

7. The combination according to claim 6, wherein the bottom tray has a projection surface against a ground plane which is larger than a corresponding projection surface of the water heater.

8. A bottom cover for a wall mounted water heater comprising:

bottom mounted valves and tube connections for water tubes, wherein the bottom cover extends below a lower part of the water heater and below the bottom mounted valves and tube connections, the bottom cover being in sealing engagement with said lower part of the water heater and being provided with passages for the water tubes, said bottom cover having, in a lower part of said cover, an outlet for an outlet tube, said outlet tube leading to a drain.

9. The bottom cover according to claim 8, wherein the passages and the outlet is adapted to water tubes and outlet tube leading into the wall.

10. The bottom cover according to claim 8, wherein the passages and the outlet is adapted to water tubes and outlet tube lead down along the wall.

* * * * *